United States Patent [19]

Henkel

[11] Patent Number: 4,757,857

[45] Date of Patent: Jul. 19, 1988

[54] MOLD FOR CASTING CYLINDER BLOCKS OF COMBUSTION ENGINES

[75] Inventor: Horst Henkel, Friedensdorf, Fed. Rep. of Germany

[73] Assignee: Fritz Winter Eisengiesserei O.H.G., Fed. Rep. of Germany

[21] Appl. No.: 58,660

[22] Filed: May 22, 1987

Related U.S. Application Data

[63] Continuation of Ser. No. 810,434, Dec. 18, 1985, abandoned.

[51] Int. Cl.[4] ..... B22C 9/24

[52] U.S. Cl. ..... 164/137; 164/29; 164/339; 164/364

[58] Field of Search ..... 164/27-32, 164/137, 339-340, 364-368

[56] References Cited

U.S. PATENT DOCUMENTS

| | | | |
|---|---|---|---|
| 2,831,225 | 4/1958 | Kolbe et al. | 164/32 |
| 2,858,587 | 11/1958 | Leach | 164/368 |
| 3,264,693 | 8/1966 | Flitz | 164/368 |
| 3,435,886 | 4/1969 | Walter | 164/340 |

FOREIGN PATENT DOCUMENTS

| | | | |
|---|---|---|---|
| 58-184040 | 10/1983 | Japan | 164/340 |
| 248905 | 6/1970 | U.S.S.R. | 164/366 |

*Primary Examiner*—Nicholas P. Godici
*Assistant Examiner*—Richard K. Seidel
*Attorney, Agent, or Firm*—Kirkpatrick & Lockhart

[57] ABSTRACT

A mold for casting cylinder blocks of combustion engines in an upright position includes a cope and a barrel core located therewith for defining a cylinder bore. A drag defines a crank space and is configured for cooperating with the cope to define a cylinder block such that the drag and cope can be stripped in an axial direction with respect to the cylinder bore.

5 Claims, 4 Drawing Sheets

MOLD FOR CASTING CYLINDER BLOCKS OF COMBUSTION ENGINES

This is a continuation of co-pending application Ser. No. 810,434 filed on Dec. 18, 1985 now abandoned.

BACKGROUND OF THE INVENTION

1. Field of the Invention

The invention relates generally to casting and more particularly to a mold for casting cylinder blocks of combustion engines.

2. Description of the Prior Art

Cylinder blocks are normally made of grey cast iron or aluminum alloys. With grey cast iron, the external contours of the cylinder block are formed by a mold of compacted molding sand (e.g. green sand comprising silica sand, bonding clay, namely bentonite, coal dust and water). The internal contours of the cylinder block are formed by means of suitable cores which are made of silica or other types of sand and a cold or hot setting binder system (resin and catalyst). The cores used in such a casting process are very expensive.

There are two types of such molds in use. The most common mold is designed to form a laterally arranged cylinder block through the use of a cope and drag. The aforesaid cores are assembled into the cope and drag which are then joined to ready the mold for casting. The mold is stripped in a direction perpendicular to the axes of the cylinder bores.

With the other mold, the cylinder blocks are cast standing upright on the base area using the aforesaid cores to form the internal contours. The mold halves, which in this particular case are laterally arranged, are also stripped in a direction perpendicular to the axes of the cylinder bores.

The demands of the automobile industry created by the pursuit of weight reduction have resulted in the need for keeping much closer casting tolerances. Unfortunately, the aforesaid casting methods both have the following disadvantages.

The distance deviations between the cope and drag are entirely transferred to a complete block half thus yielding castings with different wall thicknesses and weight differences.

The crank space of the cylinder block is formed by means of a crank space core which is considerably more expensive than the green sand used in the remainder of the mold.

It is difficult to compensate for lifting forces which develop especially in the water-jacket region during the mold filling process.

The methods are necessarily core-intensive which leads to extensive gas production during casting and solidification.

SUMMARY OF THE INVENTION

The present invention is directed to a mold for casting cylinder blocks of combustion engines in an upright position. The mold is comprised of a cope having a barrel core located therewithin for defining a cylinder bore. A drag defines a crank space without using any cores. The drag is configured for cooperating with the cope to define a cylinder block such that said drag and cope can be stripped in an axial direction with respect to the cylinder bore.

The present invention eliminates the disadvantages associated with the prior art. The present invention replaces at least one of the relatively expensive cores with moldformed contours. The crank space, for example, may be formed by green sand thus eliminating one of the relatively expensive cores. The drag and the cope are designed and arranged to allow the cylinder block to be cast in an upright position. The drag and cope can be stripped from the pattern in an axial direction with respect to the block's cylinder bores. Cylinder blocks cast in molds according to the present invention are characterized by closer dimensional tolerances, generally reduced material consumption, deminished production time, and cost savings.

Because the crank space is formed by green sand, the distances between the cylinder block's bearing supports and their width can hence be produced with a higher accuracy. It is also possible to provide for lower machining allowances. The nominal wall thickness of the casing with the surrounding tolerance field can, in comparison with conventionally cast cylinder blocks, be substanially reduced. It is no longer necessary to support the water-jacket core by chaplets. Due to its upright position, the core is no longer deformed during the casting process as is the case with conventional molds where the cylinder block is arranged in a lateral position. Furthermore, a cylinder bore with a circular outer perimeter is now possible. Said perimeter can thus be designed with minimum allowances. In summary, with the mold of the present invention, closer manufacturing tolerances coupled with an appreciable weight reduction can be realized.

The external contours of the cylinder block and the crank space can be designed without undercuts such that mold halves can be easily stripped in the axial direction. If, however, such undercuts are present, e.g. by reason of design requirements, the undercuts are formed by means of special cores, thus again making vertical mold stripping possible.

It is preferred that the horizontal external parting line between the cope and drag extend horizontally at the level of the base cylinder block area. With such an arrangement, the influence of distance deviations between the cope and drag, these deviations being always present, is completely eliminated. Such an arrangement should furthermore be preferred if the base area represents the lower surface part of an outwardly directed flange, which is often arranged at the free end of the crank space wall to serve as a connecting area for the engine's oil body. Regarding the position of the horizontal parting line between the mold halves, it can generally be said that it may extend above the base area level provided that the principle of axial stripping is maintained and it is not necessary to eliminate those disadvantages which will arise by the inevitably present distance deviations between the mold halves.

DESCRIPTION OF THE PREFERRED EMBODIMENTS

It should be mentioned that the mold designed according to the present invention for casting cylinder blocks of combustion engines is generally applicable to cylinder blocks of passenger cars, trucks, vessel drives, etc. In the following, the present invention is discussed in detail based on a preferred embodiment thereof, from which further important features are derived. However, in order to elucidate the advantages of the present invention, the aforesaid known conventional molds are shown in FIGS. 1 and 2 and described hereinafter.

Figure 1:
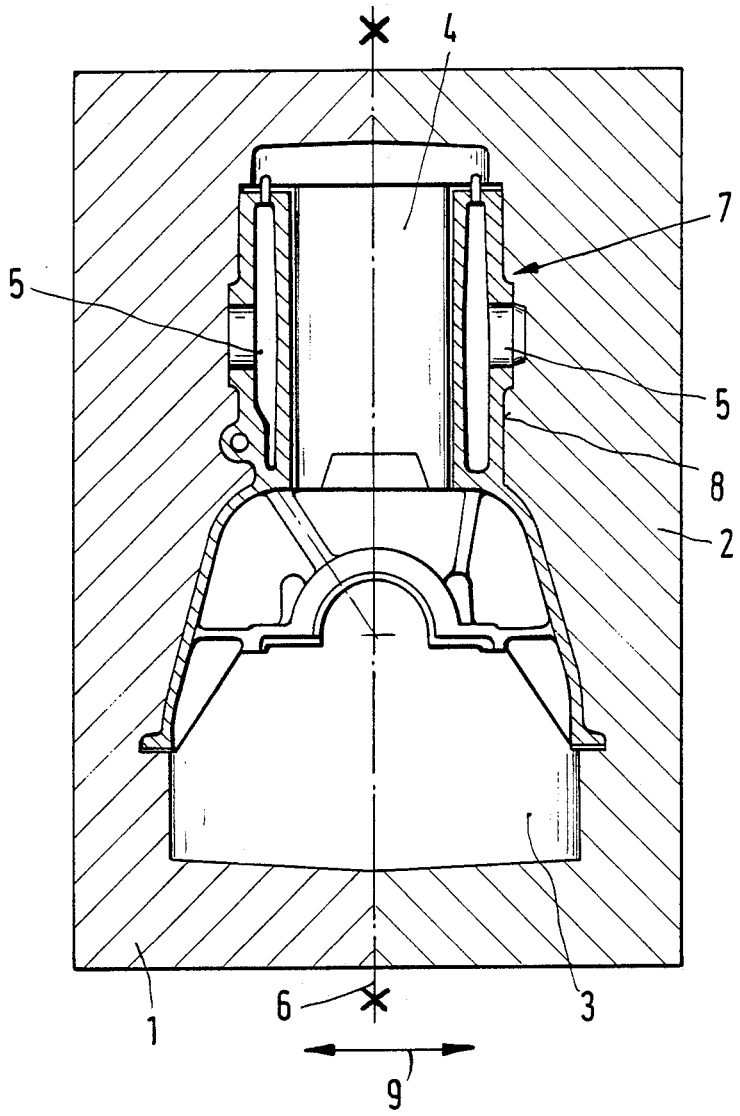
Fig. 1 Prior Art
FIG. 1 illustrates schematically a first design version of a known mold with a horizontal parting line.

The known mold shown in FIG. 1 comprises a drag 1, a cope 2, a crank space core 3, a head face slab barrel core 4, and a water-jacket core 5. A parting line 6 between the mold halves 1, 2 extends vertically coinciding with the longitudinal axis of the cylinder block 7 to be cast.

The external contour 8 of the cylinder block has some projections in the radial direction thus making axial mold stripping impossible. The mold halves 1, 2 are therefore stripped from the pattern in the radial, i.e. horizontal direction, as indicated by arrow 9.

Figure 2:
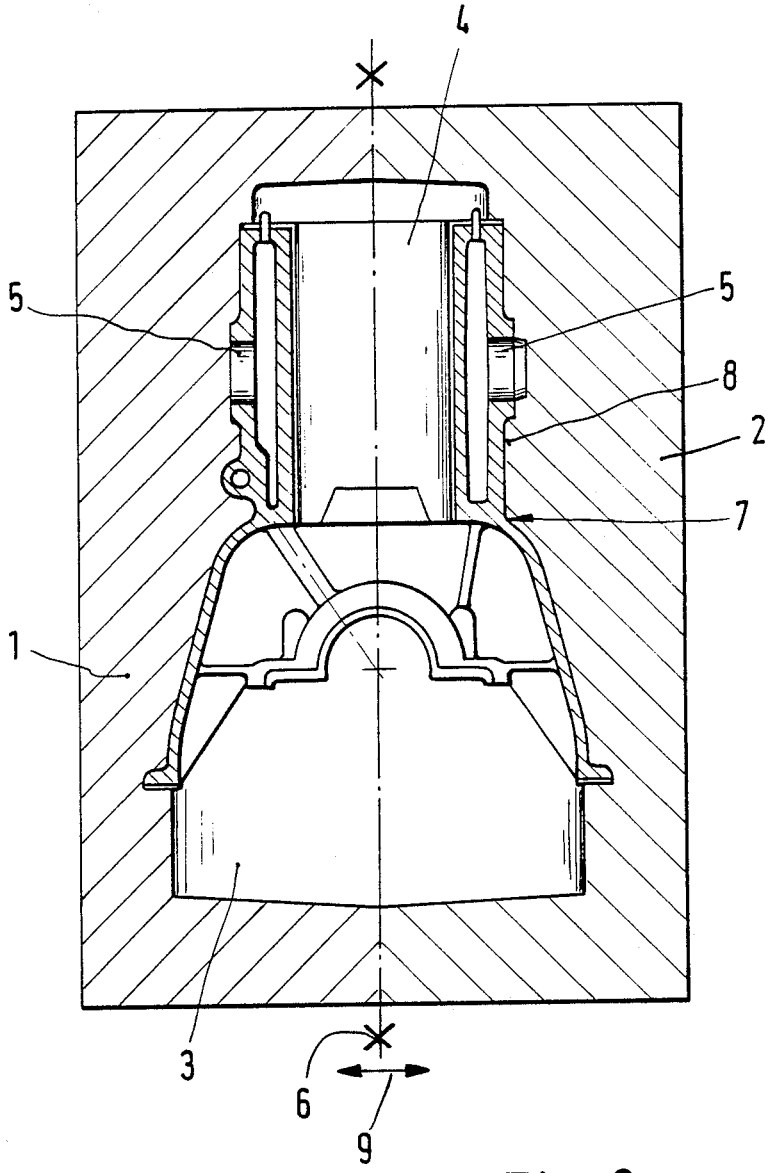
Fig. 2 Prior Art
FIG. 2 illustrates schematically a second known mold with a vertical parting line.

The well-known mold shown in FIG. 2 is basically designed according to the principle shown in FIG. 1, but with the cylinder block to be cast in an upright position being the sole deviation from FIG. 1. In FIG. 2 the mold halves are also stripped in the radial direction, i.e. in the direction indicated by arrow 9.

Figure 3:
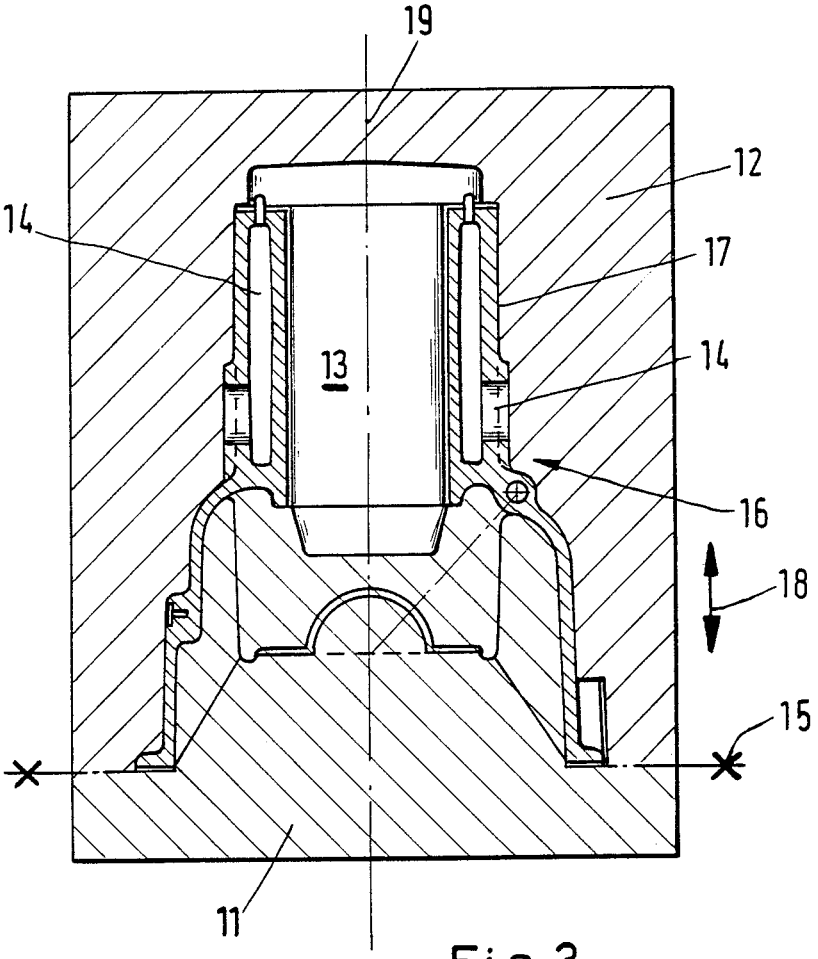
FIG. 3 illustrates schematically a mold constructed according to the present invention, designed without undercuts, and having a horizontal outer parting line.

The mold according to the present invention shown in FIG. 3 comprises a drag 11, a cope 12, a head face slab barrel core 13 and a water-jacket core 14. The drag 11 takes over the function of the crank space core 3 illustrated in FIGS. 1 and 2. A parting line 15 between the mold halves 11, 12 extends horizontally along the external mold sides namely at the level of the base area of the cylinder block 16. Inwardly adjacent to that, the parting line 15 follows the crank space contour. It is evident that the external contour 17 of the cylinder block does not reveal any undercuts. Thus the mold halves 11, 12 can be stripped axially in the direction indicated by arrow 18. (The axis is indicated as 19 in FIG. 3).

It is also evident that the crank space does not include undercuts, so the drag 11 can be stripped in a downward direction without encountering any obstacles.

Because the normally available crank space core is eliminated, being replaced by the green sand of the drag 11, the gas evolution, which would otherwise take place due to the resin binder decomposition caused by the heat in the crank space core during the casting process, is substantially reduced. Furthermore, the walls throughout the entire block can repetitively be produced within dimensional tolerances, a result not realizable hitherto.

Figure 4:
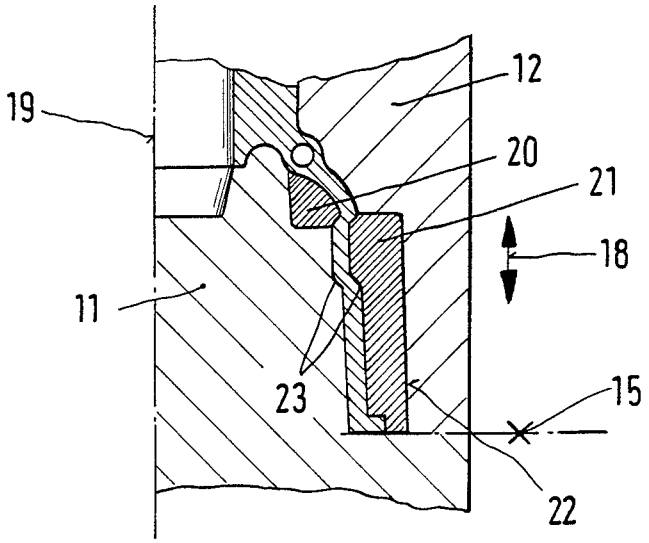
FIG. 4 illustrates schematically a partial section of a mold constructed according to the present invention with a horizontal outer parting line and with undercuts formed by means of cores.

The mold according to the invention shown in FIG. 4 corresponds essentially to that one shown in FIG. 3.

In FIG. 4, the crank space and the external contour are substantially created by the green sand mold. Undercuts are formed by the cores 20, 21 which are assembled into the drag and/or cope 11, 12, respectively. A taper 22 exists between the cope 12 and the core 21 which forms, with respect to the axis 19, an acute, downwardly opening angle. This taper, together with the radii 23 on the shoulders of the drag 11 and on the core 22, facilitate stripping the mold in the direction indicated by arrow 18.

What is claimed is:

1. A mold for casting a cylinder block for a combustion engine in an upright position, comprising:

a cope;

a water jacket core located within said cope for defining a cooling passage;

a head face barrel core located within said cope for defining cylinder bores; and a drag defining, without cores, a crank space, said drag configured for cooperating with said cope to define a parting plane therebetween, said plane extending substantially radially outward with respect to said cylinder bores, said drag and cope further defining a cylinder block such that said drag and cope can be stripped axially with respect to said cylinder bores.

2. The mold of claim 1 wherein one of said cope and said drag defines a base of the cylinder block, and wherein said parting plane extends substantially radially at substantially the same level as that of said base of the cylinder block.

3. The mold of claim 1 additionally comprising an undercut core located within said cope for defining an undercut in the cylinder block.

4. The mold of claim 1 wherein said undercut core is tapered to form, with respect to an axis of the cylinder bores, and acute angle opening downwardly thereby facilitating axial stipping of said cope.

5. A method for providing a mold for casting a cylinder block for a combustion engine in an upright position, said method comprising the steps of:

providing a cope;

locating a water jacket core within said cope for defining a cooling passage;

locating a head face barrel core within said cope for defining cylinder bores; and providing a drag defining, without cores, a crank space, said drag being configured for cooperating with said cope to define a parting plane therebetween, said plane extending substantially radially outward with respect to said cylinder bores, said drag and cope further defining a cylinder block such that said drag and cope can be stripped axially with respect to said cylinder bores.

* * * * *